US005857417A

United States Patent [19]

Hart

[11] Patent Number: 5,857,417

[45] Date of Patent: Jan. 12, 1999

[54] COIN VAULT FOR AIR MACHINES

[76] Inventor: Arthur T. Hart, 101 E. Holly Ave. Suite #3, Sterling, Va. 20164

[21] Appl. No.: 848,670

[22] Filed: Apr. 29, 1997

[51] Int. Cl.[6] ..... E05G 1/00

[52] U.S. Cl. ..... 109/55; 232/7; 232/1 D; 109/59 R; 109/74; 70/56

[58] Field of Search ..... 109/45, 46, 50, 109/55, 69, 58, 59 R, 70, 73, 74, 64; 232/7, 1 D, 93.1, 43.5, 44, 12; 70/56, 63, 163–164, 166–169

[56] References Cited

U.S. PATENT DOCUMENTS

| | | | |
|---|---|---|---|
| 2,048,810 | 7/1936 | Patche | 109/59 R |
| 3,142,522 | 7/1964 | Hall et al. | 70/389 |
| 3,808,984 | 5/1974 | Teleky | 109/59 R |
| 3,842,761 | 10/1974 | Bloom | 109/59 R |
| 3,851,942 | 12/1974 | Clay et al. | 312/333 |
| 4,131,190 | 12/1978 | Gitlin | 194/1 B |
| 4,145,978 | 3/1979 | Johnson et al. | 109/59 R |
| 4,452,371 | 6/1984 | Jurek | 220/315 |
| 4,615,280 | 10/1986 | Shoop et al. | 109/50 |
| 4,655,145 | 4/1987 | Naylor | 109/50 |
| 4,754,626 | 7/1988 | Siegel | 70/32 |
| 5,605,063 | 2/1997 | Taurog | 70/226 |
| 5,669,255 | 9/1997 | Albano | 70/424 |

*Primary Examiner*—Darnell M. Boucher
*Attorney, Agent, or Firm*—John B. Dickman, III

[57] ABSTRACT

A coin vault assembly for a self service air machine for gasoline stations. The coin vault assembly is part of a vertical base of the air machine. There is a recess in the vertical base which houses the coin vault assembly at a depth which can not be actively tampered by hacksaw, chisel, etc. The coin vault assembly has a rectangular shape with an open end covered by a pivoted removable door that pivots in a slot in the coin vault. There is a lock extension which passes thorough a slot in the door to receive a padlock. A crescent shaped lock protector further protects the lock from tampering or forced action.

6 Claims, 5 Drawing Sheets

COIN VAULT FOR AIR MACHINES

BACKGROUND OF THE INVENTION

This invention relates to devices commonly know in the art as air machines, and in particular, a coin vault for a coin operated device to protect collected money against theft.

The present day gasoline station is usually self service where patrons do their own servicing, including filling their vehicle with gasoline and checking the oil and other fluids. These "gas and go" stations are manned by one attendant who does not leave a secured building where patrons pay for purchases. Most of these stations have self service air pumps and vehicle vacuums. It is not unusual for a station owner to charge for these services, therefore, there are coin operated mechanisms which control the time of use of the air pumps and vacuums.

As would be the case, for every honest means for making money, there is a group of thieves and misfits who plot and work to steal from cash boxes of unattended self service equipment. As shown by the volume of patented art on cash vaults for self service equipment this is not just a recent problem. However, today the problem is magnified with the number of self service gas stations. The most recent U.S. patents on coin vaults for self service equipment are Heraty, U.S. Pat. No. 4,037,700, Volk, U.S. Pat. No. 4,579,214 and Halsey et al, U.S. Pat. No. 5,129,501. Of these patents, Heraty is interesting in that it is a coin vault for a vacuum machine in a car wash service station. Other that the field of the invention, Heraty or none of the other patents known to the inventor are similar to the present invention. A common problem with the prior art is that the coin boxes have been secured by lock and key exposed to exterior tampering or forcing action.

It is therefore one object of the present invention to provide a coin vault assembly in which the lock is protected from tampering or forced actions.

Another object of the present invention is a coin vault built into the base of an air machine and recessed into the base to protect against tampering or forced actions.

Still another object of the present invention is a coin vault having an impregnable heavy steel construction including a removable door that once installed provides no openings or edges for tampering or forced action by tools and the like.

A still further object is that all components but the compressor are in the device for easy access.

SUMMARY OF THE INVENTION

A coin vault is provided in the base of an air compressor mechanism which has a coin operated compressor for inflating the tires of a vehicle. There is a coin mechanism which trips an electrical timing device connected to the motor. Coins inserted in the coin mechanism pass through the mechanism and through a conduit into a coin vault.

The base of the air compressor mechanism is constructed from an impregnable heavy steel construction so that a supposed thief would be discouraged from attempting to cut through the base into the coin vault, using a hacksaw or other tool. To further protect the coin vault, it is recessed in the base at a depth beyond which a thief can manipulate a hacksaw, chisel or jimmy tool.

The coin vault is also constructed of an impregnable heavy steel and is permanently built into the base. The coin vault has a rectangular box shape open at one end to receive a removable door. There is a hole in the top of the vault connecting the vault to the conduit from the coin mechanism. One side of the vault has an opening to receive an edge of the door. The other side of the vault has an extension which passes through a slot in the door to receive a hardened steel padlock. The door is sized to snugly fit within the recess in the base and provide no open areas between the door and the vault. A crescent shaped lock protector surrounds the slot in the door through which the vault extension passes. The protector also completely shields the padlock except for the key slot area, to prevent the use of hacksaws, chisels and similar tools on the lock. The padlock is circullar in shape and has no exposed hasp that can be hacksawed or chiseled away.

DESCRIPTION OF THE INVENTION

Figure 1:
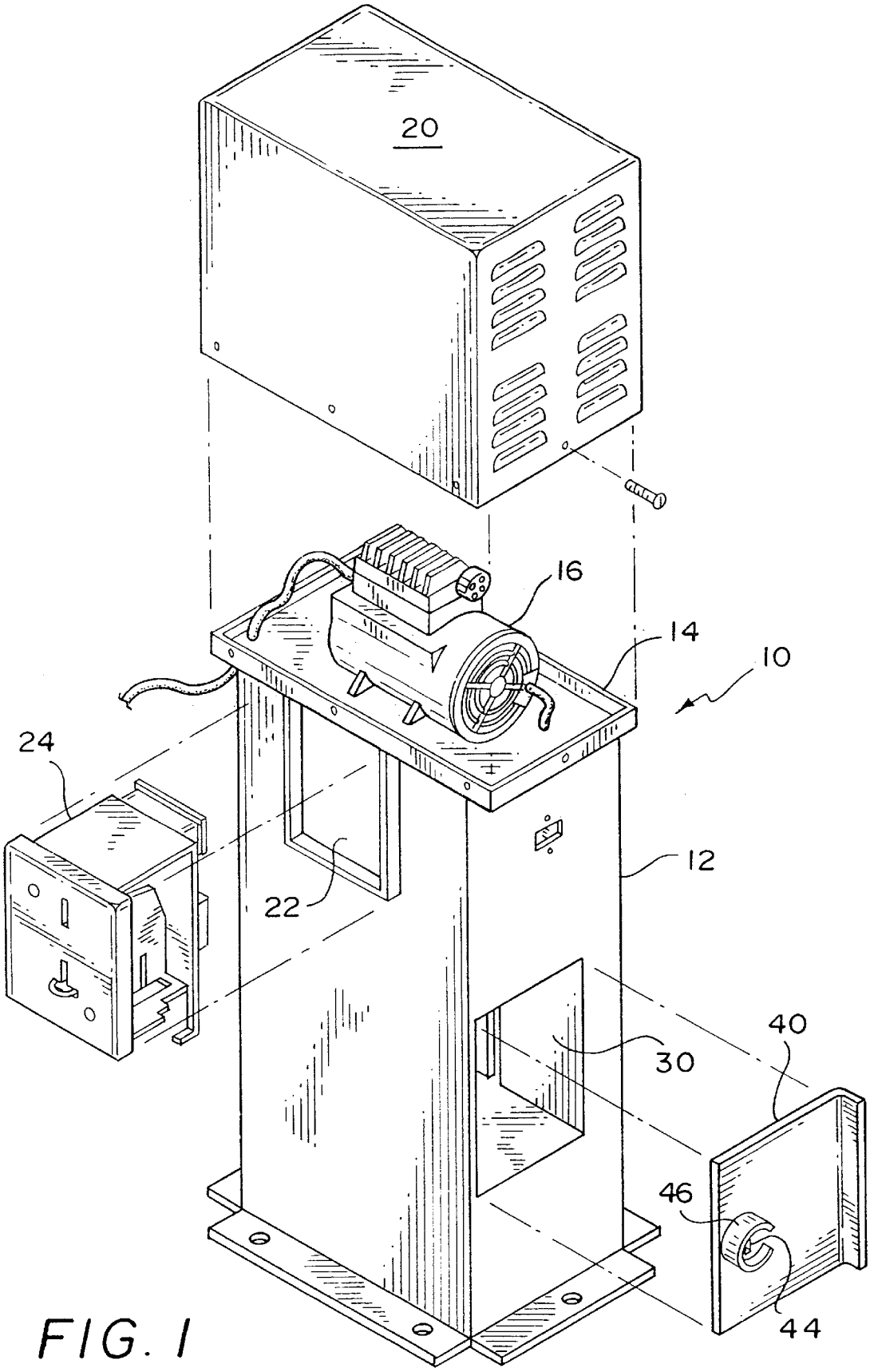
FIG. 1 is a perspective view of a coin operated air machine with parts unassembled to clearly show the different parts.
Figure 2:
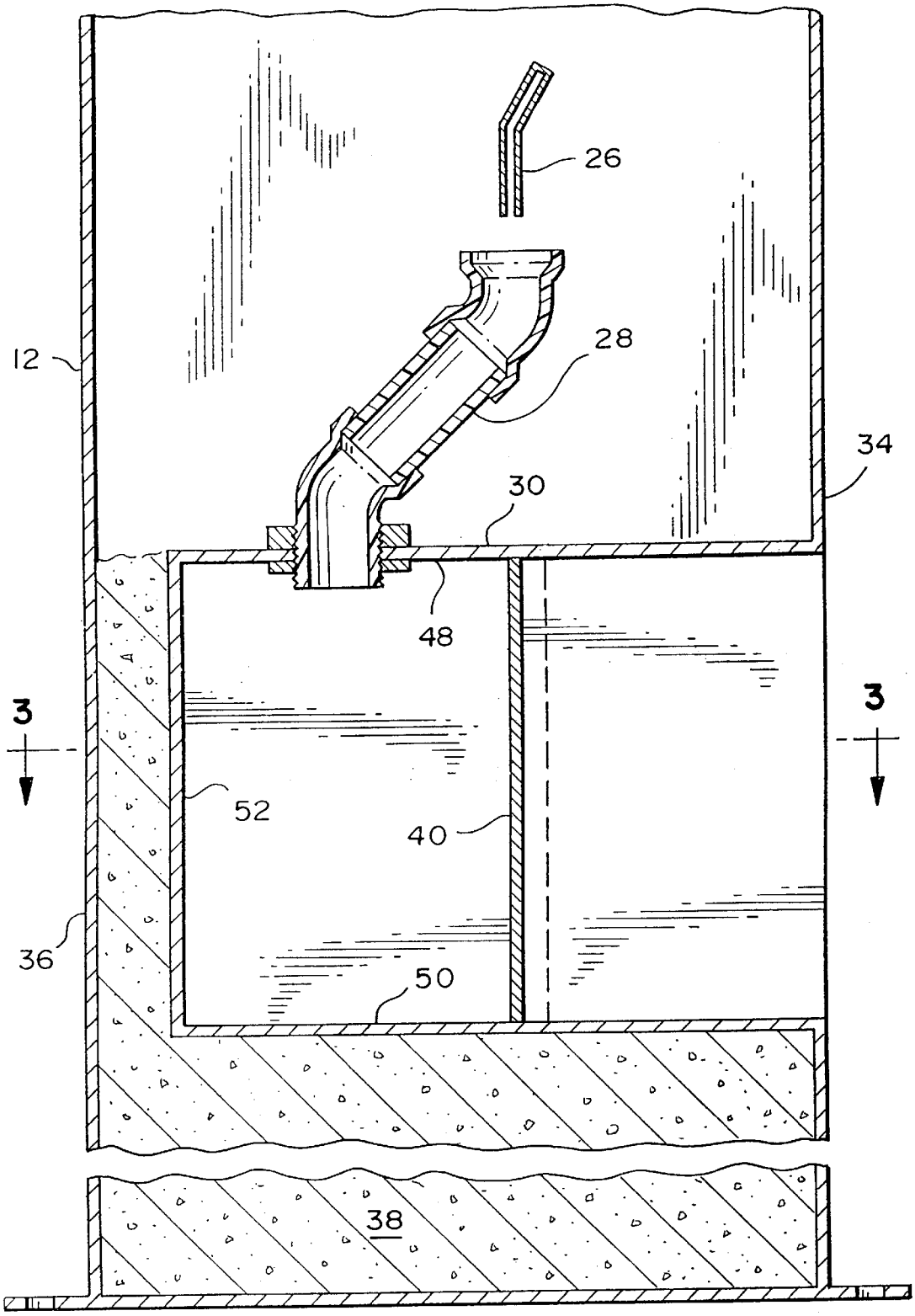
FIG. 2 is a partial cross-section showing the lower section of an air machine base.

Referring to the drawings, FIGS. 1–6 there is shown an air machine mechanism 10 having a vertical upright base 12 of hardened steel having a rectangular shape and four walls with a top support 14 for an electrically driven air compressor motor 16. A rectangular cover 18 attaches to the top support 14 to protect the vacuum 16 from weather conditions. An opening 22 in one of the walls near the top of the base receives a coin mechanism 24 for operating the motor 16. The coin mechanism 24 is connected to an electrical timing switch, not shown, to limit the operation of the motor 16. The coin mechanism 24 receives a coin which trips the timing switch. FIG. 2 shows a tube 26 which connects at one end to the coin mechanism 24. The other end of tube 26 is centered over an open conduit 28 to direct coins from the coin mechanism 24 to a coin vault 30. The conduit 28 is open at both ends with the lower end connected to the coin vault.

In FIG. 1, a recessed opening 32 forms the interior and exterior of the coin vault 30. The full length of the recess extends from wall 34 to within a few inches of wall 36, as shown in FIG. 2. Looking at FIG. 2, the interior of the base is filled with concrete 38 to weight it against vandalism, cutting tourches, etc.

Figure 3:
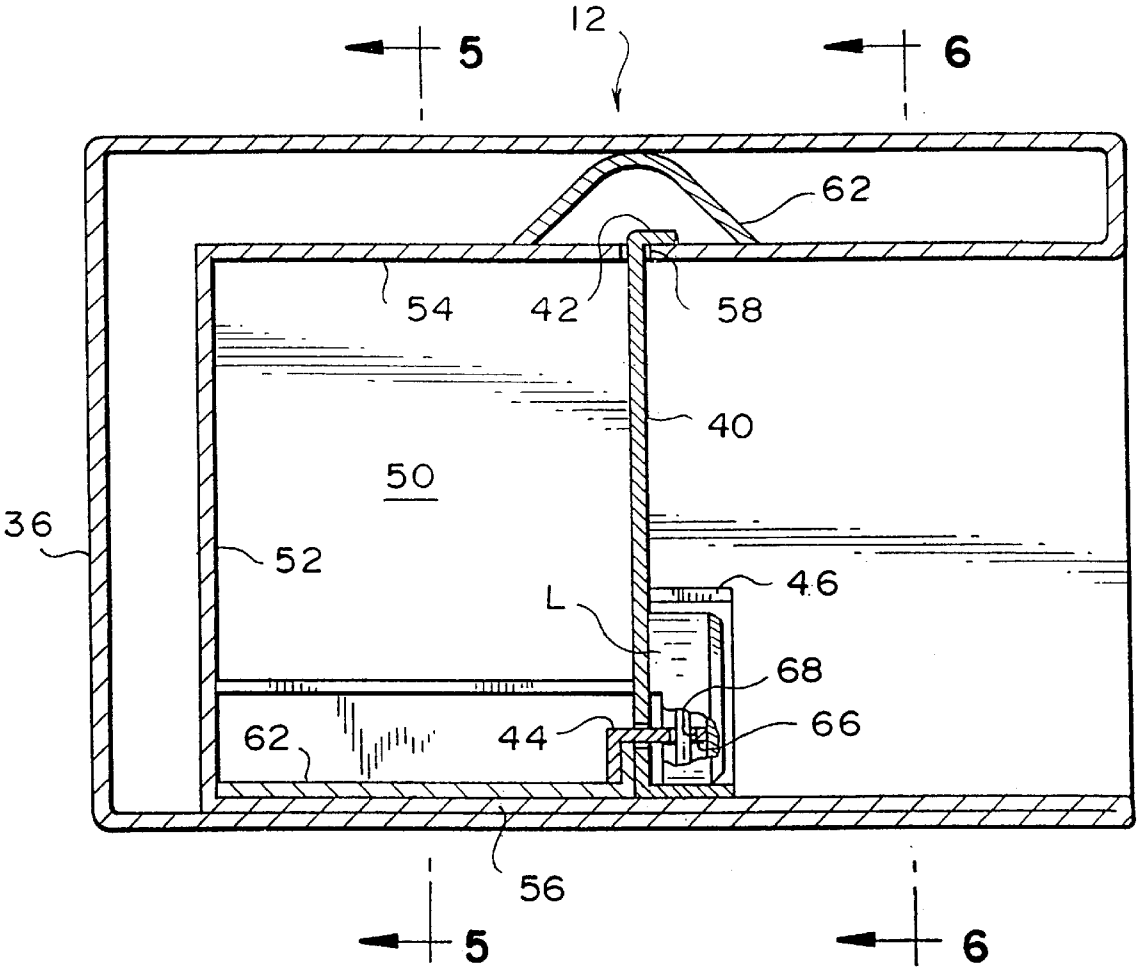
FIG. 3 is a cross-section taken along the line B—B of FIG. 2 showing a coin vault recessed in the base.
Figure 4:
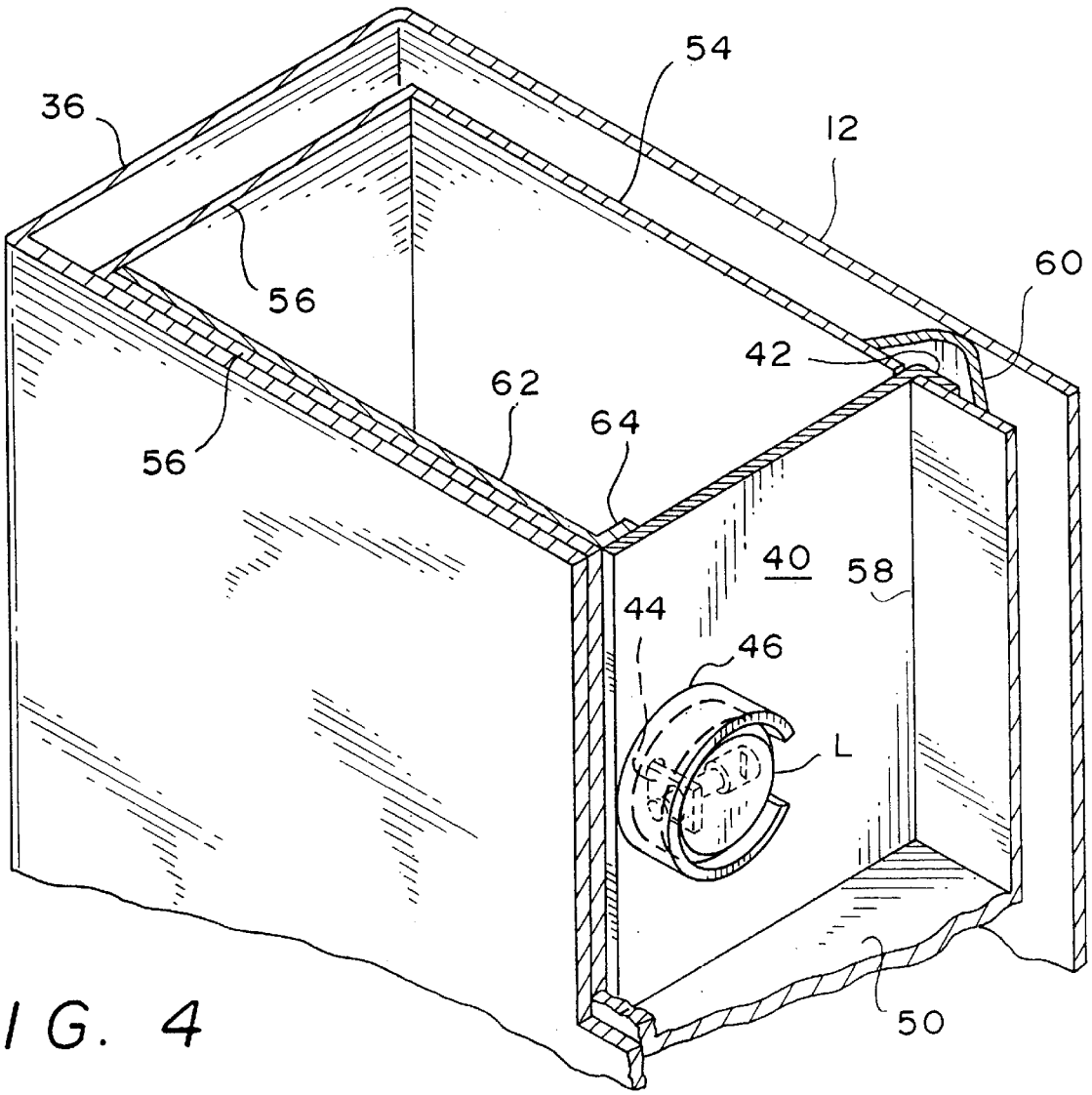
FIG. 4 is a perspective of a partial cross-section of a base showing a coin vault.
Figure 6:
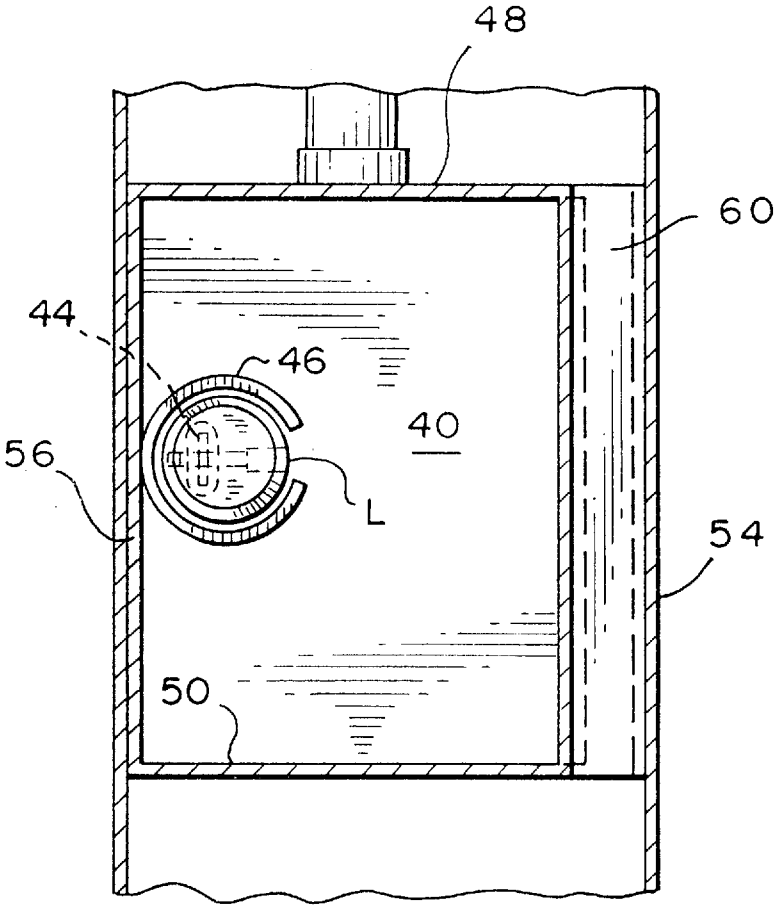
FIG. 6 is a cross-section taken along the line D—D of FIG. 3.
Figure 5:
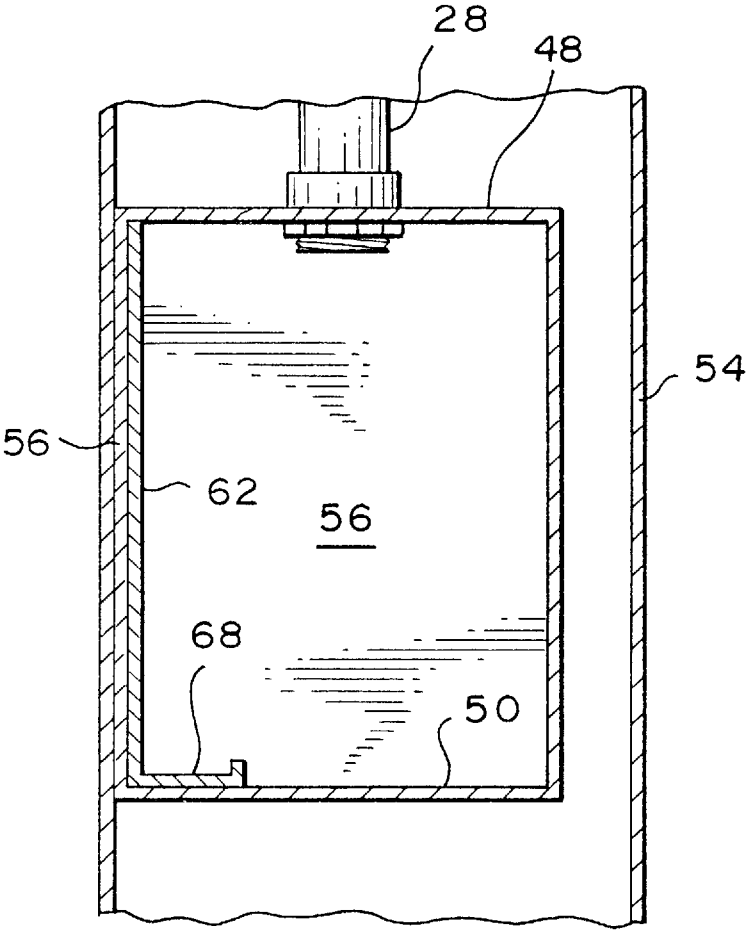
FIG. 5 is a cross-section taken along the line C—C of FIG. 3.

A vault door 40 is shown in FIGS. 1, 4 and 6. The door 40 is a heavy steel plate with a right angle end 42. A slot 44, FIG. 3, and a crescent shaped lock protector 46 near the opposite end, complete the door.

Turning to FIGS. 2–6, the coin vault 30 is shown to be rectangular in shape, having a top wall 48, a bottom wall 50, a rear wall 52, and side wall 54 and a second side wall 56. Side walls 54 and 56 and top wall 48 and bottom wall 50 also form the exterior recess 30 in base 12. Side wall 54 has a vertical slot 58 which receives the right angle end 42 of door 40 so that the cooperation between the slot 58 and the right angle end 42 of door 40 allows the door to pivot and be removed when necessary. A V-shaped support 60 is welded to the outside of side wall 54 and extends the vertical height of the wall to reinforce the area surrounding slot 42. Side wall 56 has an interior wall 62 welded to it. Wall 62 has a right angle end 64 which serves as a stop for door 40. FIG. 3 shows an L-shaped extension 66 welded to the right angle end 64 aligned with the slot 44 in door 40. There is an opening 68 through which a padlock L locks the door shut. Wall 62, shown in FIG. 5, has an L-shaped partial lower wall 68 welded to bottom wall 50 for additional strength.

Crescent shaped lock protector 46 is substantually C-shaped with the opening of the C for key access to lock and unlock padlock L. The crescent shaped lock protector 46 tampers toward the open ends to make it easier to manipulate the padlock L.

In use, coins are dropped into the coin vault 30 through conduit 28. The vault is recessed in the base 12, as stated, to prevent tampering. Door 40 is completely removable by pivoting it against wall 54 and slipping the right angled end 42 out of slot 58. Installing the door 40 is the reverse of the process. When opening the door 40, padlock L is removed from extension 44 which allows the door to pivot. Since the vault 30, including door 40 are recessed, it makes it impossible to use hacksaws, chisels or other cutting tools on the padlock L.

It is important that metals be used that are capable of withstanding attempts at forced entry into the vault, and while hardened steel is discussed, other suitable materials may also be used.

While only one embodiment of the invention has been disclosed, it is suggested that the disclosure, drawings and claims should be studied for a complete understanding of the invention.

What is claimed is:

1. A coin vault assembly for coin operated devices, comprising:

a vertical base of rectangular shape having a top surface to support a coin operated device, a coin mechanism for receiving coins to operate said device and a recess below said coin mechanism, a coin vault in said recess for receiving coins from said coin mechanism, said coin vault having a rectangular shape with a top, bottom, rear wall and a pair of side walls, where an open end is sealed by a removable door having means to lock said door between said side walls by a pivotable means and a locking means; and, said coin vault being positioned in said recess at a depth to prevent tampering and force entry, said side walls including a first wall having a vertical slot and a V-shaped support on the exterior of said coin vault to reinforce said first wall in the area surrounding said vertical slot, and a second wall having an extension means on said wall to extend through said door to receive said locking means.

2. A coin vault assembly as in claim 1 wherein said second wall has an interior wall welded to it where said interior wall has a right angle end stop means to abut said door as a stop, and where said extension means is secured to said right angle end stop means.

3. A coin vault assembly as in claim 1 wherein said door has a first end and a second end, where said first end has a right angle shape for insertion in said slot of said first wall for pivoting said door, and where a slot is near said second end to receive said extension means from said second wall.

4. A coin vault assembly as in claim 3 wherein said extension means has an aperture for receiving a padlock which secures said door to said coin vault.

5. A coin vault assembly as in claim 4 wherein said door has a crescent shaped lock protector partially surrounding said door slot and said extension means to protect said padlock from tampering and forced action.

6. A coin vault assembly as in claim 4, wherein said door has a lock protector surrounding said door slot and said extension means to protect said padlock from tampering and smashing by vandals and criminals.

* * * * *